US011352773B2

(12) United States Patent
Miller et al.

(10) Patent No.: US 11,352,773 B2
(45) Date of Patent: Jun. 7, 2022

(54) METHOD OF MAKING A DRAWN SINK HAVING LOW-PROFILE RIM

(71) Applicant: Kohler Co., Kohler, WI (US)

(72) Inventors: Jason R. Miller, Sheboygan Falls, WI (US); Brian Siehr, McAllen, TX (US); Theodore Nikolai, Port Washington, WI (US); Joseph Bolden, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 17/127,177

(22) Filed: Dec. 18, 2020

(65) Prior Publication Data

US 2021/0102361 A1 Apr. 8, 2021

Related U.S. Application Data

(62) Division of application No. 15/601,112, filed on May 22, 2017, now Pat. No. 10,900,209, which is a division of application No. 13/855,499, filed on Apr. 2, 2013, now Pat. No. 9,689,151.

(60) Provisional application No. 61/620,163, filed on Apr. 4, 2012.

(51) Int. Cl.
*E03C 1/18* (2006.01)

(52) U.S. Cl.
CPC ..... *E03C 1/18* (2013.01); *Y10T 29/49826* (2015.01)

(58) Field of Classification Search
CPC ..... B21D 51/18; B21D 22/26; E03C 1/33; E03C 1/18; E03C 1/335
See application file for complete search history.

(56) References Cited

U.S. PATENT DOCUMENTS

| | | | | |
|---|---|---|---|---|
| 2,582,463 | A | 1/1952 | Skinner | |
| 2,679,052 | A * | 5/1954 | Walsh | E03C 1/33 4/636 |
| 2,846,695 | A | 8/1958 | Hartog | |
| 3,013,851 | A | 12/1961 | Maron | |
| 3,020,563 | A | 2/1962 | Just | |
| 3,029,445 | A | 4/1962 | Just | |
| 3,040,338 | A | 6/1962 | Zeleny | |
| 3,110,040 | A | 11/1963 | Richardson | |
| 4,236,060 | A | 11/1980 | Butz | |
| 4,613,995 | A * | 9/1986 | Rieke | E03C 1/33 4/633 |
| 4,932,565 | A | 6/1990 | Paradiso | |
| 5,016,297 | A | 5/1991 | Sauter et al. | |
| 5,644,943 | A * | 7/1997 | Lanz | B21D 22/26 72/348 |
| 6,021,532 | A * | 2/2000 | Rieke | E03C 1/33 4/633 |
| 6,793,190 | B2 * | 9/2004 | White | E03C 1/33 248/500 |
| 8,356,367 | B2 | 1/2013 | Flynn | |
| 2006/0253974 | A1 | 11/2006 | Schneider et al. | |

(Continued)

*Primary Examiner* — Lee A Holly
(74) *Attorney, Agent, or Firm* — Folev & Lardner LLP

(57) ABSTRACT

A method for making a sink with a supporting structure, comprising: drawing a sink including at least one basin and a rim extending outwardly from at least one side of the at least one basin; and coupling a support structure in the form of at least one channel to an underside of the at least one side of the rim using a tool; wherein the tool includes a channel support configured to receive one channel of the at least one channels.

20 Claims, 8 Drawing Sheets

(56) References Cited

U.S. PATENT DOCUMENTS

| | | | |
|---|---|---|---|
| 2007/0176448 | A1 | 8/2007 | Spykerman et al. |
| 2009/0144893 | A1 | 6/2009 | Cusimano |
| 2012/0222212 | A1 | 9/2012 | Booth et al. |
| 2012/0261533 | A1 | 10/2012 | Booth |
| 2013/0061389 | A1 | 3/2013 | Huber |

* cited by examiner

METHOD OF MAKING A DRAWN SINK HAVING LOW-PROFILE RIM

CROSS-REFERENCE TO RELATED PATENT APPLICATIONS

This application is a Divisional of U.S. patent application Ser. No. 15/601,112, filed on May 22, 2017, which is a Divisional of U.S. patent application Ser. No. 13/855,499, filed on Apr. 2, 2013 (now U.S. Pat. No. 9,689,151), which claims the benefit of and priority to U.S. Provisional Patent Application No. 61/620,163, filed on Apr. 4, 2012. The entire disclosures of the foregoing applications are hereby incorporated by reference herein.

BACKGROUND

This application relates generally to sinks, and, more particularly, to drawn sinks having low-profile rims.

SUMMARY

According to one exemplary embodiment, a drawn sink having a low-profile rim includes at least one channel coupled to an underside of a mounting rim of the sink to increase the rigidity of the sink and also to increase the flatness of the mounting rim to aid in installation of the sink to a countertop.

According to another exemplary embodiment, a method of manufacturing a sink includes drawing a stainless steel sheet to form at least one basin with a mounting rim extending outwardly from an upper portion of the basin. The method also includes coupling at least one channel to an underside of the mounting rim to increase the rigidity of the sink and also to increase the flatness of the mounting rim to aid in installation of the sink to a countertop. The at least one channel may be welded to the mounting rim or may be glued to the mounting rim.

Another embodiment relates to a sink including a basin, a rim extending outwardly from the basin, a support member in the form of a channel coupled to an underside of a portion of the rim to increase the rigidity of the rim, and a mounting element operatively coupled to the channel and configured to secure the rim to a fixture.

Another embodiment relates to a sink including at least one basin, a rim extending outwardly from at least two adjacent sides of the at least one basin, and at least two support members including a first support member coupled to an underside of a first side of the at least two adjacent sides of the rim and a second support member coupled to an underside of a second side of the at least two adjacent sides of the rim. The at least two support members are configured offset from an outer periphery of the rim to increase the rigidity of the rim.

Yet another embodiment relates to a method for making a sink with a supporting structure. The method includes drawing a sink including at least one basin and a rim extending outwardly from at least one side of the at least one basin. The method also includes coupling a support structure in the form of at least one channel to an underside of the at least one side of the rim using a tool, where the tool includes a channel support configured to receive one channel of the at least one channels.

DETAILED DESCRIPTION

Figure 1:
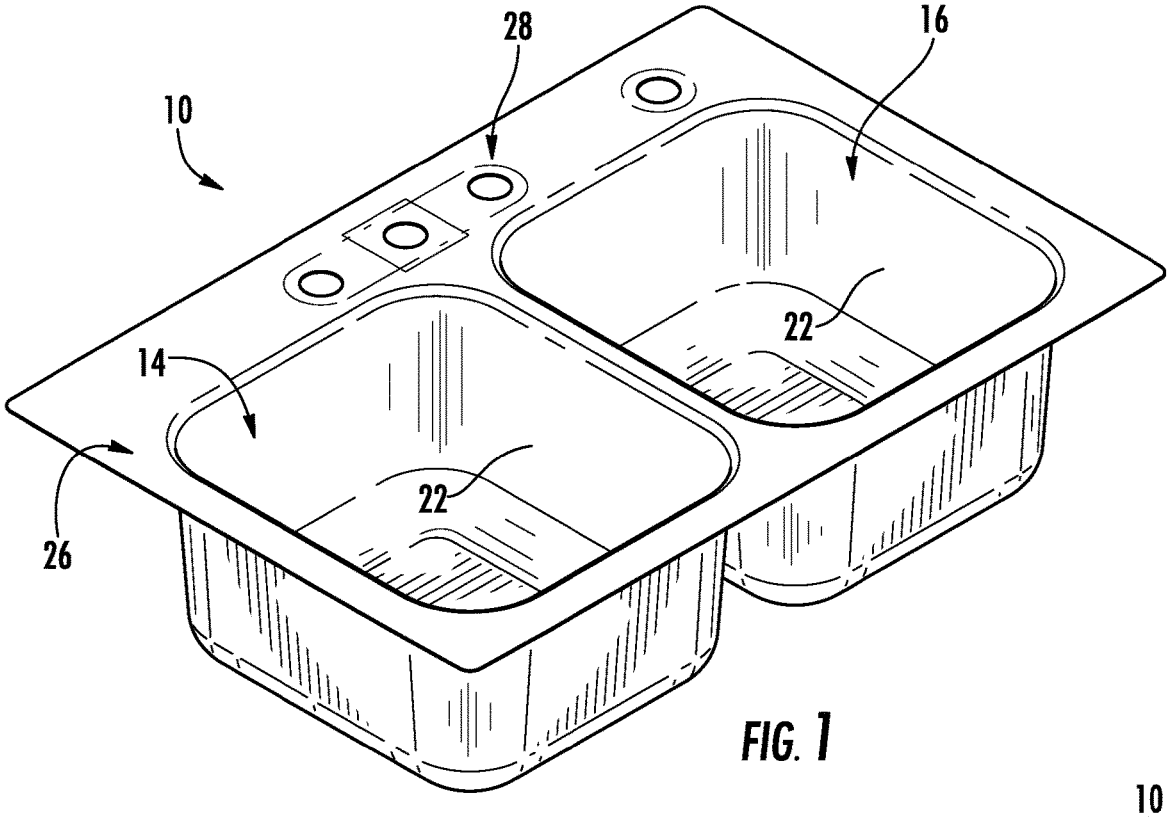
FIG. 1 is a perspective view of a sink according to an exemplary embodiment.
Figure 2:
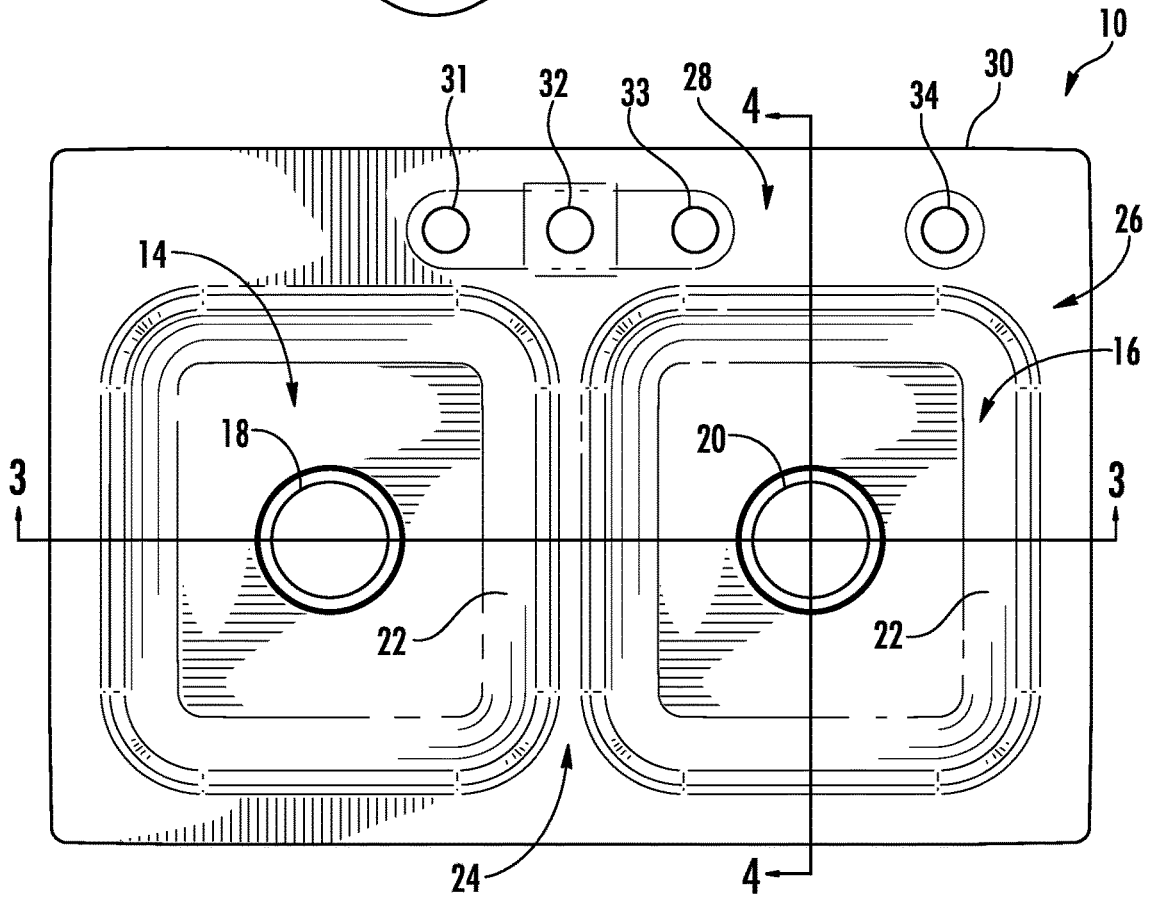
FIG. 2 is a top view of the sink of FIG. 1.
Figure 3:
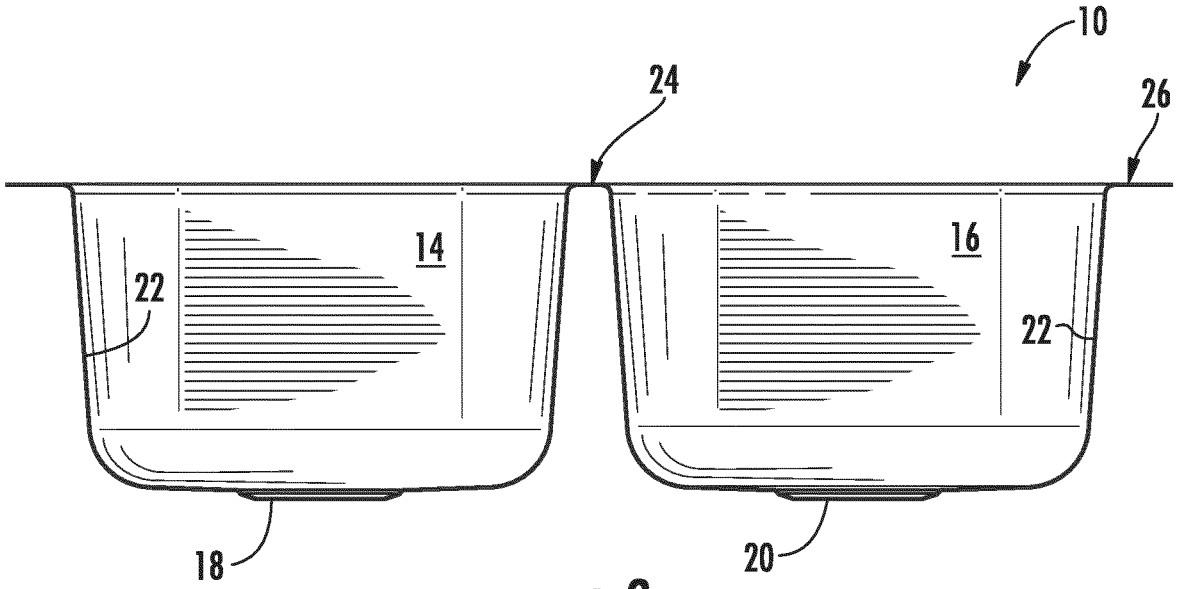
FIG. 3 is a cross-sectional view of the sink of FIG. 1 taken through line 3-3 of FIG. 2.
Figure 4:
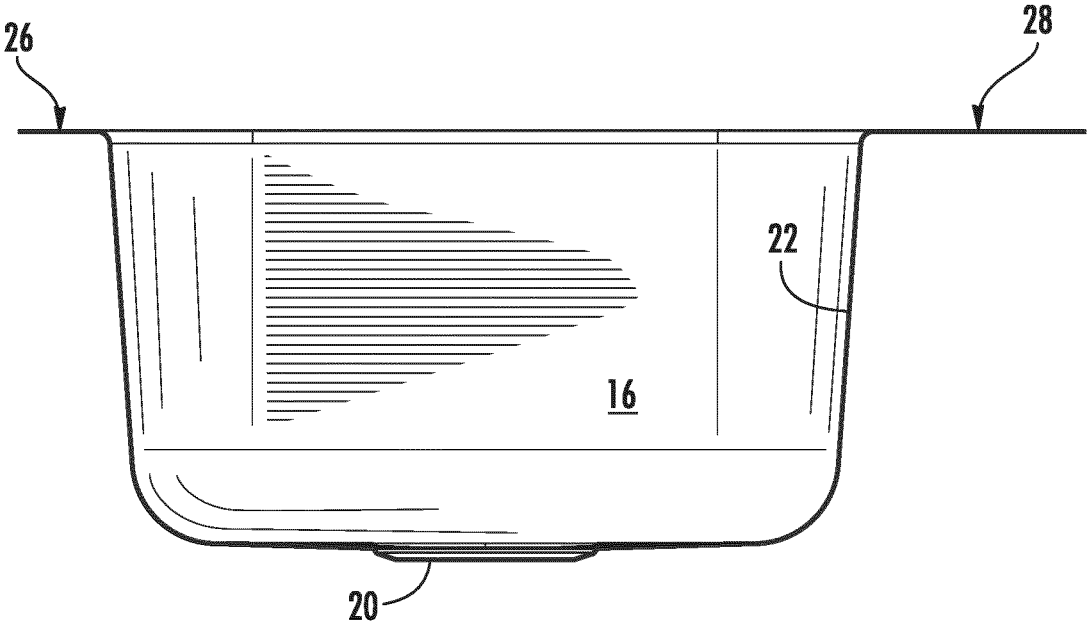
FIG. 4 is a cross-sectional view of the sink of FIG. 1 taken through line 4-4 of FIG. 2.
Figure 5:
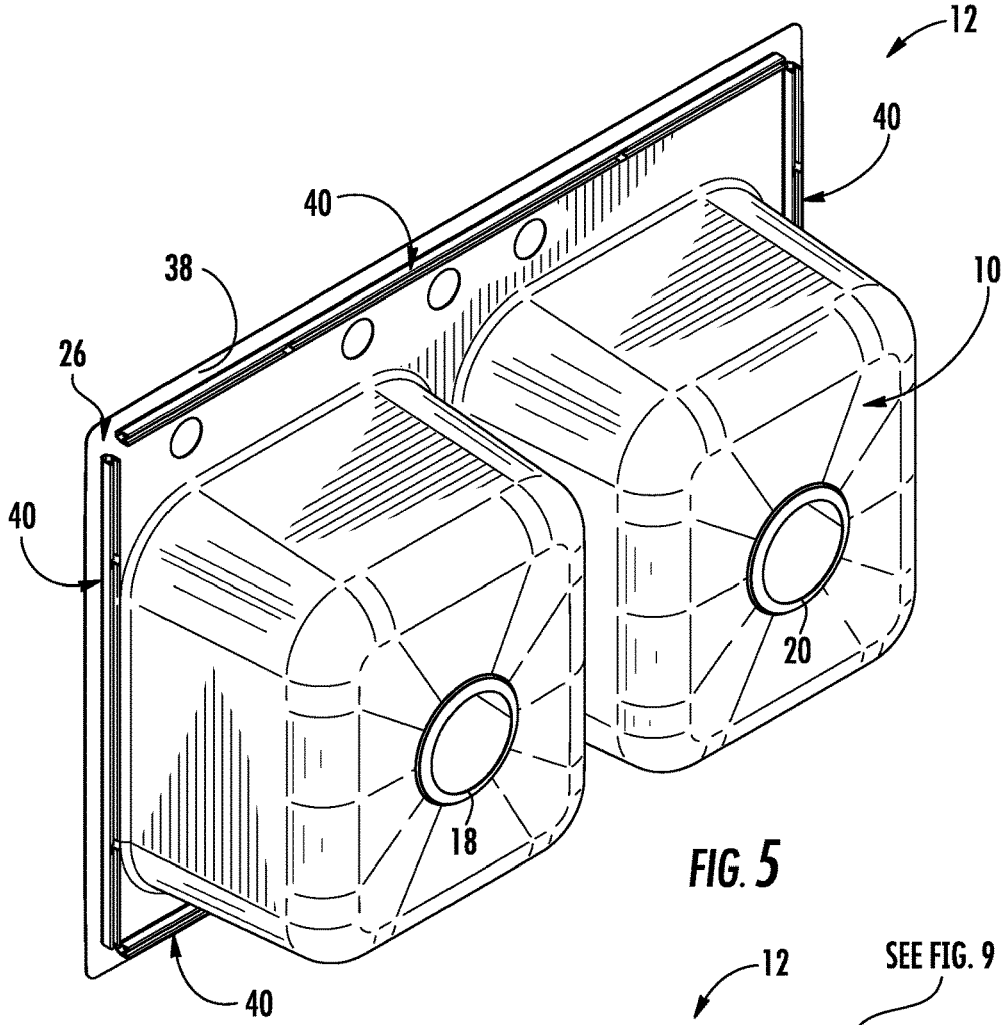
FIG. 5 is a bottom perspective view of the sink of FIG. 1 including support channels according to an exemplary embodiment.

Referring generally to the FIGURES, an exemplary embodiment of a countertop mountable sink 10 and an assembly 12 incorporating the sink 10 are illustrated. Among other benefits, channels coupled to a mounting rim of the sink may strengthen and inhibit warping of a mounting rim of the sink. The improved planarity of the mounting rim and any associated faucet deck facilitates the convenient and hassle-free installation of the sink and any plumbing fixtures thereto. Further, the channels coupled to the mounting rim may also provide a structure configured to receive multiple fasteners, such as installation clips, during installation of the sink. These and other benefits are found in the disclosed assembly.

Referring first to FIGS. 1 through 4, the sink 10, according to one exemplary embodiment, includes a left side basin 14 and a right side basin 16. At the bottom of each of the left and right side basins 14 and 16 are drain openings 18 and 20, respectively, which can be connected to outlet plumbing (not shown). Walls 22 extend generally upwardly from the drain openings 18 and 20 to define the shape of the two basins 14 and 16. As shown, the two basins 14 and 16 are disposed adjacent to one another (e.g., next to one another) and are separated by a centrally located saddle 24. While the shape of the basins have a particular configuration in FIG. 1, it should be noted that the concepts described herein may be applicable to sinks having basins with other configurations according to other exemplary embodiments.

Dual basin sinks are particularly useful in a kitchen because each basin can be dedicated to a different purpose. For example, one of the basins can be dedicated to washing dishes, while the other basin can be dedicated to rinsing dishes. According to other exemplary embodiments, however, a sink could have a different number, size, and/or shape of basins and/or be used in a different environment. For example, in a bathroom or lavatory, it may be desirable that the sink only have a single basin. In other embodiments, one basin may have a size and/or shape that is different than the other basin.

In the exemplary embodiment shown in FIGS. 1 through 4, at an upper end of the sink 10, a mounting rim 26 extends outwardly from the walls 22 that define the basins 14 and 16. The mounting rim 26 is shown as a flange that generally horizontally extends away from the basins 14 and 16; however, in other exemplary embodiments, the mounting rim 26 may not be a flange.

Additionally, there is an integrated faucet deck/platform 28 disposed between the upper portion of the basins 14 and 16 and an outer periphery 30 of the mounting rim 26. In the exemplary embodiment shown, the faucet deck 28 is located rearwards of the basins 14 and 16.

The faucet deck 28 includes pre-formed holes 31, 32, 33, 34 suitable for installing a faucet, sprayer, or other water controls (not shown) and can accommodate a water supply conduit. By including these holes in the faucet deck 28 itself, the difficulty of locating, aligning, and drilling faucet holes in a countertop at the site of installation can be avoided. As one of ordinary skill in the art would readily recognize, the inclusion and/or location of pre-formed holes 31, 32, 33, 34 may be varied. For example, only a single hole (e.g., hole 32) may be included in the faucet deck 28. Alternatively, only the hole 32 and the hole 34 may be included in the faucet deck 28 according to another exemplary embodiment.

The pre-formed holes 31, 32, 33, 34 may receive a faucet and/or sprayer (not shown) that may be positioned over the basins 14 and 16 to supply water. The faucet head may be capable of swinging (e.g., swiveling) such that the faucet head may be positioned over either one of the basins or neither of the basins. In this way, water could be supplied to either basin and, further, the faucet head can be cleared from an area above a selected basin so as to provide clearance for the insertion of large objects (such as for example, a large pot) into the selected basin.

Although the faucet deck 28 is shown as part of the sink 10 in the illustrated exemplary embodiment, in other embodiments, there may be no faucet deck or the faucet deck may be differently positioned relative to the basin or basins. For example, as illustrated, the faucet deck 28 is generally co-planar with the mounting rim 26; however, it is also contemplated that the faucet deck 28 could be downwardly offset from the plane of the mounting rim 26 or angled in part or in whole to avoid the collection of water at the mounting rim 26.

In the exemplary embodiment shown, the sink 10 is made of a metal such as, for example, an 18-gauge stainless steel which contains alloyed nickel additions and is formed using a drawing process (e.g., a deep drawing process). Other materials may be used according to other exemplary embodiments. The drawing process may include one draw step or multiple draw steps in which, for example, the basins 14 and 16 are separately formed. In the exemplary embodiment illustrated, the sink 10 has large, generous corner radii which permits improved flow of material during the drawing process thereby potentially eliminating the need for additional draw steps (i.e., the sink 10, including both basins 14 and 16, might be drawn in a single draw step). If the radii were not as generous, then additional draw steps may be required.

Typically, when a sink of the type described is formed by a drawing process, the mounting rim of the sink is, at least to some degree, warped as a result of the drawing process (e.g., because of the differential draw performed across various segments of the sink). Warping of the mounting rim significantly complicates installation of the sink because the mounting rim must then be forced to be flush with the countertop over its entire area during installation. To overcome warping (e.g., counteract, straighten out, etc.), the mounting rim is often secured to the countertop at a large number of locations and/or using a large number of mounting elements (e.g., by clips, etc.) which adds time and cost to the installation process.

Likewise, a faucet deck could also become warped as a result of the drawing process. If the faucet deck was warped, then the faucet deck would not be suitable for the mounting of a faucet and/or other water controls.

The inventors of the present disclosure were surprised to find that by coupling a member or structure (such as, e.g., a channel 40 as shown in FIGS. 5 through 10) to the mounting rim 26, using a process as will be described in further detail below, the strength of the mounting rim 26 was significantly improved (e.g., the mounting rim 26 was generally stiffened) and warping of the mounting rim 26 and faucet deck 28 was significantly reduced, generally resulting in improved planarity/flatness of the mounting rim 26 and the faucet deck 28.

Referring now to FIGS. 5 through 11, an exemplary sink assembly 12 is illustrated in which a plurality of members or structures 40 defining channels are coupled to the sink 10 (hereinafter, such members or elements will be referred to as "channels 40" for brevity). As shown in FIGS. 5 through 11, a total of four channels 40 are attached or coupled to an underside 38 of the mounting rim 26. However, a greater or lesser number of channels may be coupled to the mounting rim 26 according to other exemplary embodiments. Thus, the sink assembly 12 may include first, second, third, and fourth channels 40 coupled to an underside of first, second, third, and fourth sides of the rim 26. Additionally, the first and third channels 40 may be configured generally parallel, and the second and fourth channels 40 may be configured generally parallel. The first and third channels 40 may be configured generally perpendicular to the second and fourth channels 40. As one of ordinary skill in the art would readily recognize, any suitable coupling process may be utilized. For example, a suitable coupling process may include welding (such as, e.g., laser, resistance, spot, ultrasonic, etc.), gluing (or other adhesive based process), or the use of fasteners (screws, rivets, etc.).

Figure 6:
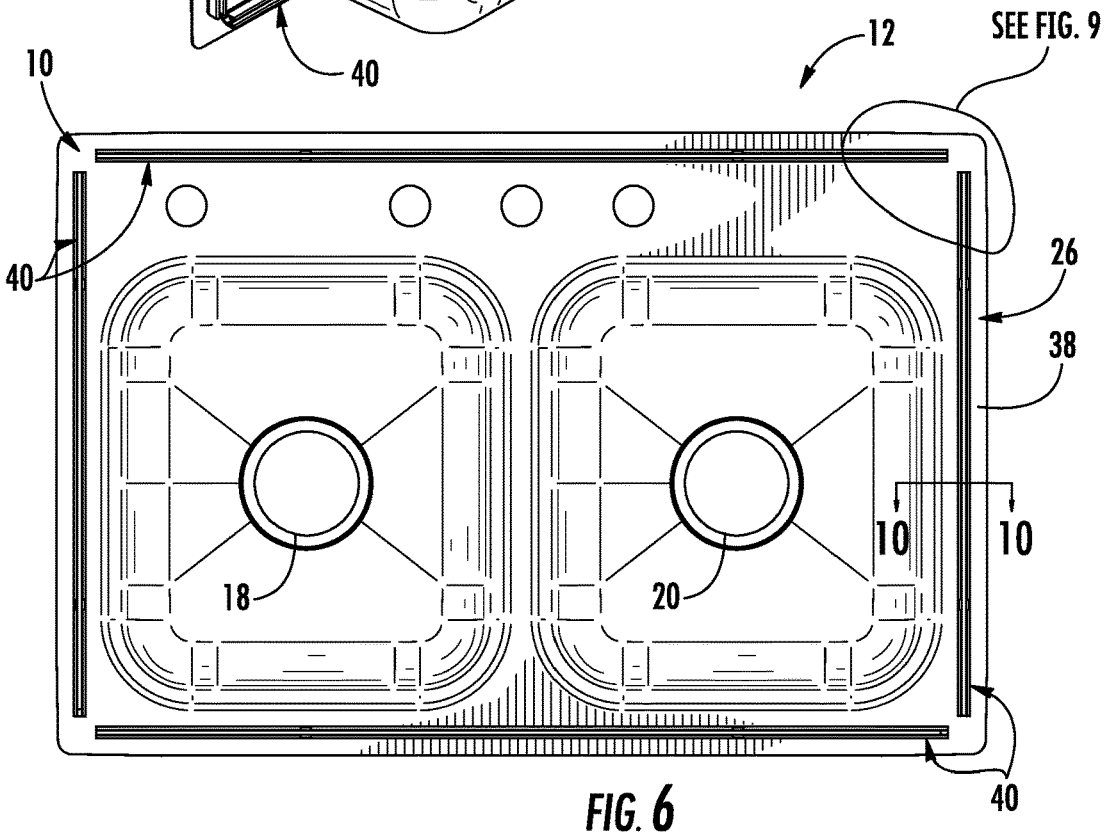
FIG. 6 is a bottom view of the sink of FIG. 5.
Figure 7:
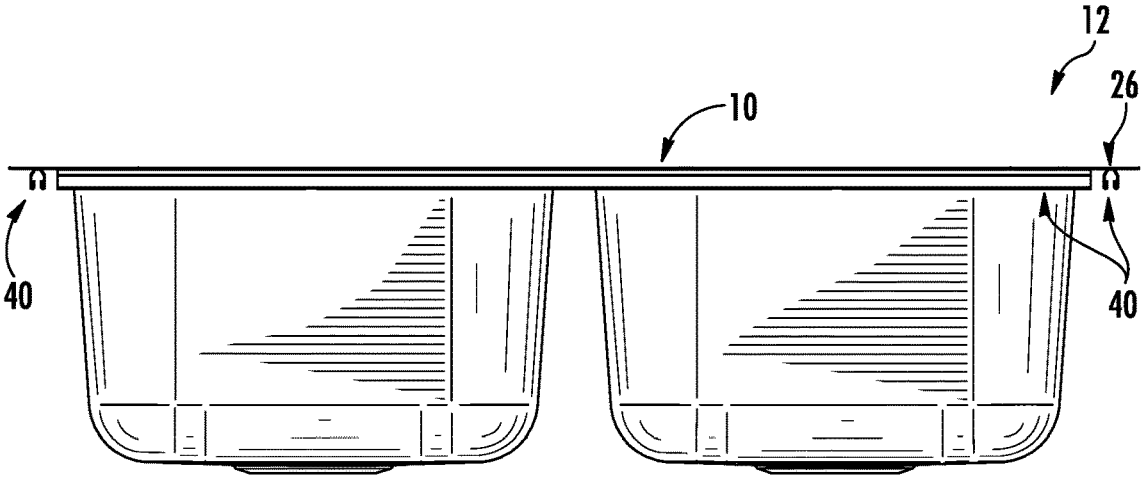
FIG. 7 is a front view of the sink of FIG. 5.
Figure 8:
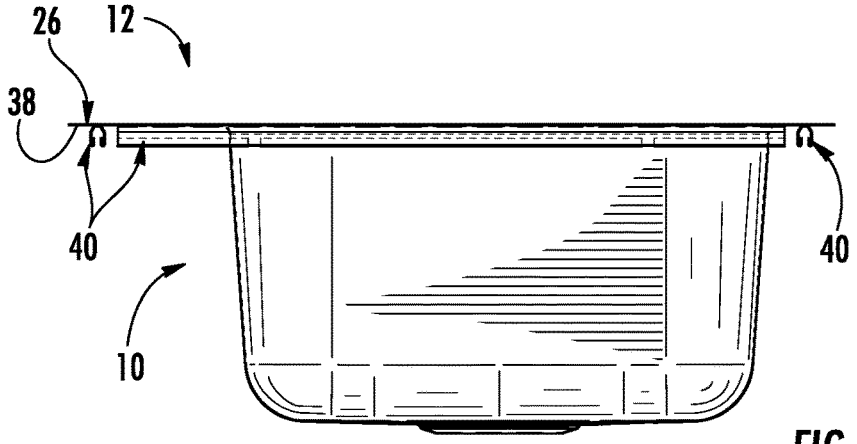
FIG. 8 is a right side view of the sink of FIG. 5.
Figure 9:
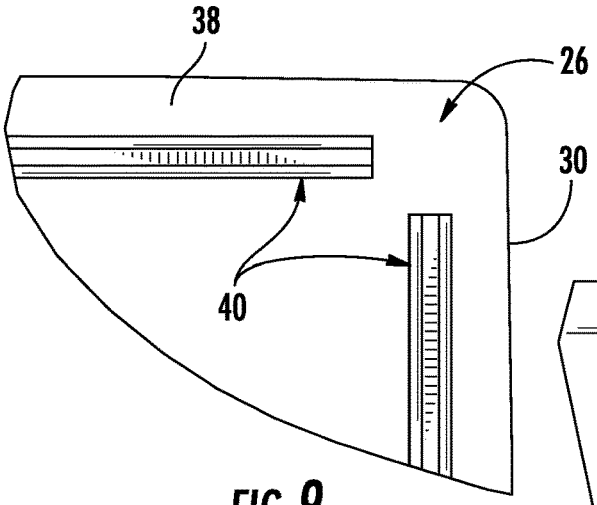
FIG. 9 is a detailed view of a corner region of the sink of FIG. 6.

As best seen in FIGS. 6 and 9, the channels 40 are offset from the outer periphery 30 of the mounting rim 26. Being offset from the outer periphery 30 creates a space or gap on the underside 38 of the mounting rim 26 that is used as a mounting surface to locate the sink 10 on a countertop (e.g., countertop 50 shown in FIG. 11). This offset may vary, for example, depending on the amount of overlap desired between the mounting rim 26 and the top of the countertop 50.

Figure 10:
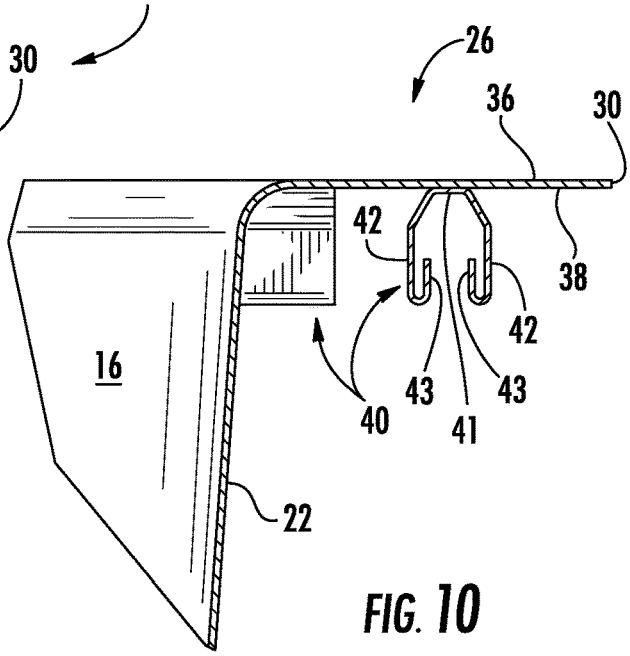
FIG. 10 is a cross-sectional view of a portion of the sink of FIG. 6 taken through line 10-10 of FIG. 6.

According to one exemplary embodiment, each channel 40 has a profile shape as shown, for example, in FIG. 10. The channel 40 includes a base portion 41 (e.g., a base) that is configured to be coupled to the underside 38 of the mounting rim 26. As seen in FIG. 10, the base portion is a generally planar body. The base portion 41 has two arms 42 (e.g., legs) extending out and away from the underside 38 of the mounting rim 26. Thus, the channel 40 may include a pair of spaced apart arms 42 extending away from the base portion 41 (and away from an underside of the rim 26).

Figure 11:
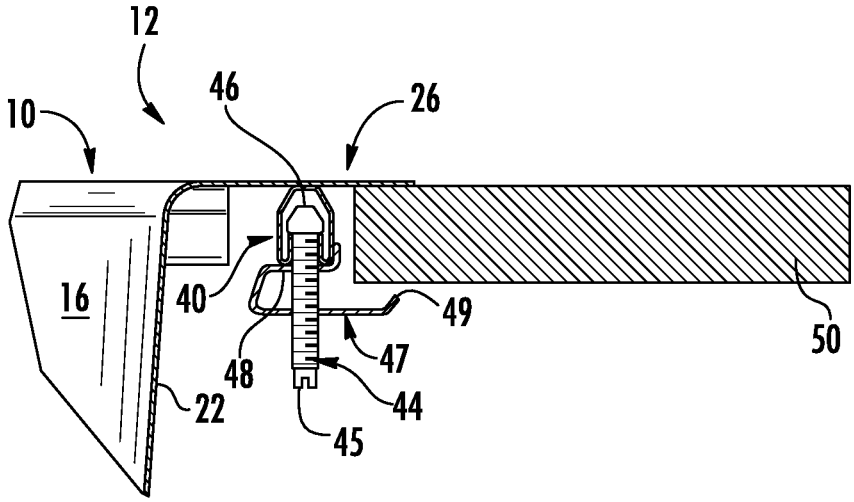
FIG. 11 is a cross-sectional view of a portion of the sink of FIG. 10 showing the sink coupled to a countertop according to an exemplary embodiment.

Each channel 40 may also include a curved member. For example, each arm 42 may include a curved member 43. As shown in FIG. 10, the channel 40 includes a curved member 43 extending from an end of each arm 42 opposite the base portion 41. Each curved member 43 may extend inwardly from the end of the arm 42. As shown, each curved member 43 is configured having generally a J-shape with a leg extending inwardly toward the base portion 41. The curved members 43 may be configured to receive a portion of a fastener (e.g., the fastener 44 as shown in FIG. 11). For example, the leg of the J-shape of the curved member 43 may extend generally parallel to the arm 42 and may receive a portion of the fastener 44.

Although a specific channel geometry is depicted, the channel 40 could have other shapes, sizes, and/or configurations. For example, the channel could include two generally vertical walls joined by a generally horizontal base wall or could be generally V-shaped, generally U-shaped, generally C-shaped, generally D-shaped, etc. According to other exemplary embodiments, the channel need not be symmetrical (e.g., the channel may be generally L-shaped). However, it may be advantageous to form the channel having a symmetric configuration. For example, the loads (e.g., the clamping loads) in the system from the mounting element(s) may be distributed (e.g., divided) through the two arms 42 of the symmetrically configured channel 40. Also, for example, the symmetrically configured channel 40 may receive a fastener (e.g., the fastener 44) directly, such as by the curved members 43. Additionally, the legs of the curved members 43 may provide for an adequate length of thread engagement with the threads of the fastener to manage the clamping loads without the need for additional members to retain the fastener.

In the exemplary embodiment shown in FIGS. 5-11, the ends of the channels 40 are spaced apart from one another, allowing for more clearance space when installing the sink 10 into a cutout of a countertop. As shown in FIGS. 5-11, the channels 40 do not form a completely closed loop round the basins 14 and 16, but rather extend generally along the sides of the sink as a number of segments/portions (e.g., right, left, front, and bottom segments/portions).

Figure 12:
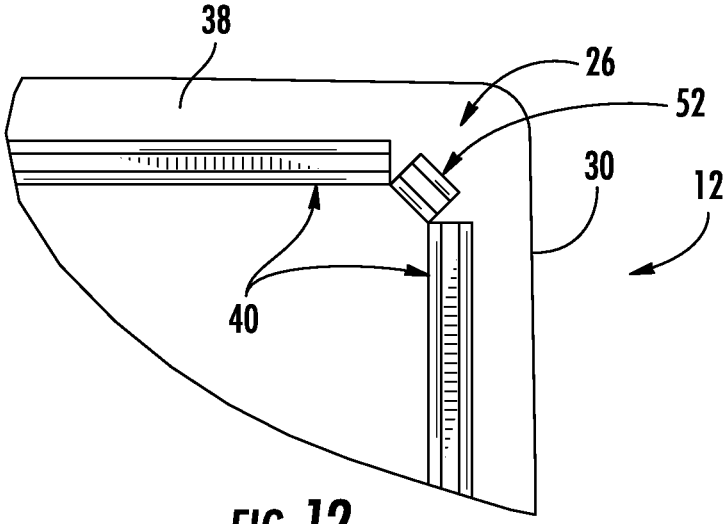
FIG. 12 is a detailed view of a corner region of the sink of FIG. 9 according to another exemplary embodiment.

According to another exemplary embodiment, the ends of the channels 40 may be generally connected, e.g., by a member 52, as shown in FIG. 12. As shown in FIG. 12, the member 52 is provided at an angle (e.g., a 45 degree angle) to the adjacent channels 40. Thus, the channels 40 (e.g., first and second channels or support members) may be connected by a member 52 configured at a first angle relative to the first channel 40 and a second angle relative to the second channel 40.

According to one exemplary embodiment, the member 52 has a similar profile to that of the channel 40. For example, the member 52 may be created by cutting (e.g., snipping) one of the channels 40, and then bending the newly formed member 52 until it contact the adjacent channel 40. Thus, the member 52 may have a cross-sectional profile that is the same as a profile of the first channel 40 (e.g., the first support member) and a profile of the second channel 40 (e.g., the second support member), as shown in FIG. 12. For example, each profile may be configured to include a base (e.g., the base portion 41) and a pair of spaced apart arms (e.g., arms 42) extending away from the base. Alternatively, the member 52 may have a profile different than that of the channels 40, as well as being a completely separate component from the channels 40.

Figure 13:
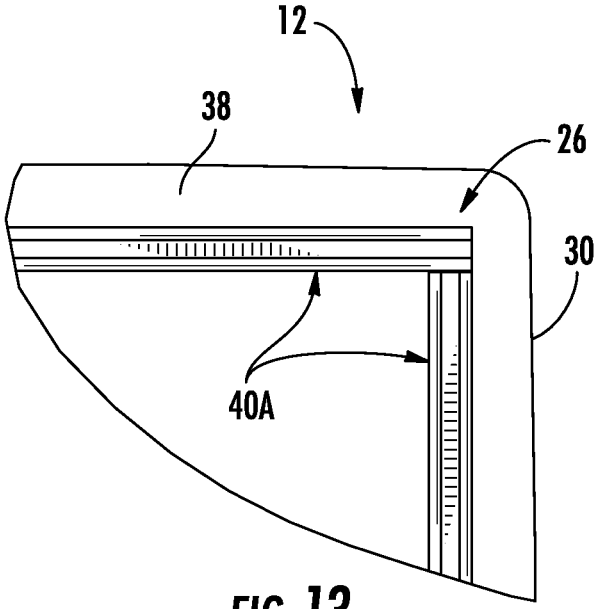
FIG. 13 is a detailed view of a corner region of the sink of FIG. 9 according to another exemplary embodiment.

According to another exemplary embodiment, the channels extend all around the mounting rim 26, forming a substantially closed loop around the basins 14 and 16 (such as, e.g., channels 40A as shown in FIG. 13). In this exemplary embodiment, the end portions of the channels 40A have been extended such that they make contact with one another. For example, an end surface of the end of one channel 40A may contact a side surface of the end of an adjacent channel 40A, such as to couple the channels 40A together.

Referring now to FIG. 11, the sink assembly 12 is shown mounted to a countertop 50. In particular, the mounting rim 26 of the sink 10 is mounted to the top surface of the countertop 50. As such, the mounting rim 26 of the sink 10 has a low-profile look and appearance. In other words, a topside 36 of the mounting rim 26 is only slightly elevated from the top surface of the countertop 50, so that a generally smooth transition exists between the mounting rim 26 and the countertop 50. In fact, because of the increased rigidity and flatness characteristics the channels 40 provide for the sink 10, the mounting rim 26 can be a generally flat, planar member extending from the basins 14 and 16 out to the outer periphery 30. In other words, the mounting rim 26 is a flat member that extends outward from the basins 14 and 16 to the countertop 50, with no extra features or profile changes to the mounting rim 26 between the basins 14 and 16 and the countertop 50.

Once the sink 10 is positioned within a cutout of the countertop 50, a plurality of mounting elements may be used to anchor and retain (e.g., mount, fasten, support, etc.) the sink 10 in place relative to the countertop 50. In the exemplary embodiment of the sink assembly 12 shown in FIG. 11, each mounting element includes a fastener 44 used in combination with a mounting clip 47 to secure the sink 10 to the countertop 50. The fastener 44 includes a head 46 that is received in the curved members 43 of the channel 40 (e.g., in a snap-fit configuration). The fastener 44 also includes a driving end 45 configured to be driven by a tool (e.g., a screwdriver) to turn or rotate the fastener 44. Rotation of the fastener 44 acts to tighten the clip 47 to the bottom of the countertop 50. For example, a first portion 48 of the clip 47 is rotatably coupled to the fastener 44 near the channel 40 and a second portion 49 of the clip 47 has a free end configured to contact the bottom of the countertop 50. As the fastener 44 is rotated, the free end of the second portion 49 of the clip 47 is drawn into engagement with the bottom of the countertop 50, thereby securing the mounting rim 26 of the sink 10 to the top of the countertop 50.

Each clip 47 may also include a portion connecting the first and second portions 48, 49 of the clip 47. As shown in FIG. 11, a connecting portion in the form of a webbing interconnects the first portion 48 of the clip 47 and the second portion 49 of the clip 47 in an offset manner. Thus, the, first and second portions 48, 49 of the clip 47 may be spaced apart by the webbing. The webbing may interconnect the first and second portions 48, 49 of the clip 47 such that the second portion 49 is moveable relative to the first portion 48. For example, tightening the fastener 44 may be configured to move the second portion 49 relative to the first portion 48 in order to move the free end of the second portion 49 into engagement with a bottom of a fixture, such as the countertop 50. The clip 47 may be configured to abut or contact the channel 40. For example, the first portion 48 of the clip 47 may be configured to abut the curved member 43 of the channel 40 to limit the travel of the clip 47 relative to the channel 40. As shown in FIG. 11, a top surface of the first portion 48 is configured to abut a bottom outside surface of the curved member 43 to limit an upward travel of the clip 47 relative to the channel 40.

According to an exemplary embodiment, the mounting elements are disposed at various locations about the mounting rim 26 of the sink 10. If the channels 40 were not coupled to the mounting rim 26, then the mounting rim 26 may be comparatively more warped and therefore require significantly more mounting elements to secure the sink 10 to the countertop 50. Thus, by including the channels 40, fewer mounting elements are required to mount the sink assembly 12 to the countertop 50, saving both cost and time of mounting the sink assembly 12 to the countertop 50.

Figure 14:
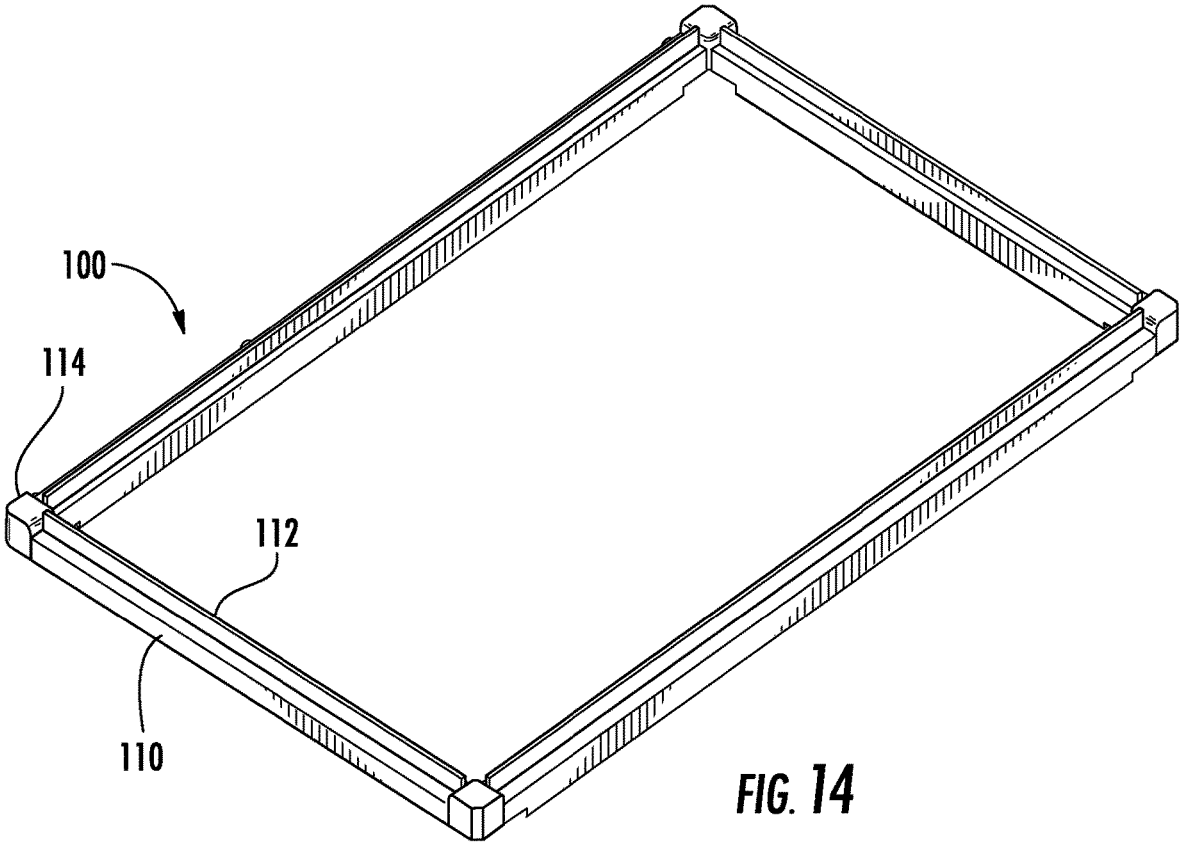
FIG. 14 is a perspective view of a portion of a manufacturing tool used to assemble the sink of FIG. 5 according to an exemplary embodiment.

As discussed above, various methods of coupling the channels 40 to the mounting rim 26 may be employed. With respect to FIGS. 14-19, one such method will be described in further detail. As shown in FIG. 14, a portion of a manufacturing tool 100 is shown according to an exemplary embodiment. The manufacturing tool 100 is shown to include a set of base members 110 that are coupled together at their respective ends by a corner member 114 to form a generally rectangular support (e.g., to receive a generally rectangular sink). Each base member 110 includes a channel support 112 coupled to an upper portion thereof.

Figure 15:
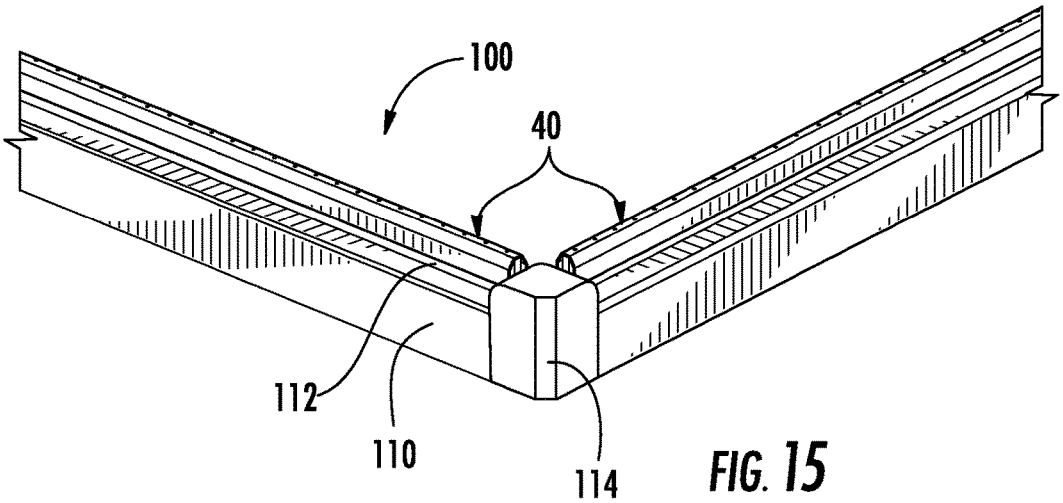
FIG. 15 is a detailed view of the manufacturing tool of FIG. 14 showing the placement of the channels according to an exemplary embodiment.

As shown in FIG. 15, each channel support 112 is configured to receive a corresponding channel 40. As such, each channel support 112 has an exterior profile to match the interior dimensions of the channel 40 so that the channel 40 can be provided over at least a portion of the channel support 112. According to the exemplary embodiment shown in FIGS. 14 and 15, the channel support has a generally rectangular profile. However, according to other exemplary embodiments, the channel support may have a different profile shape and/or configuration.

Figure 16:
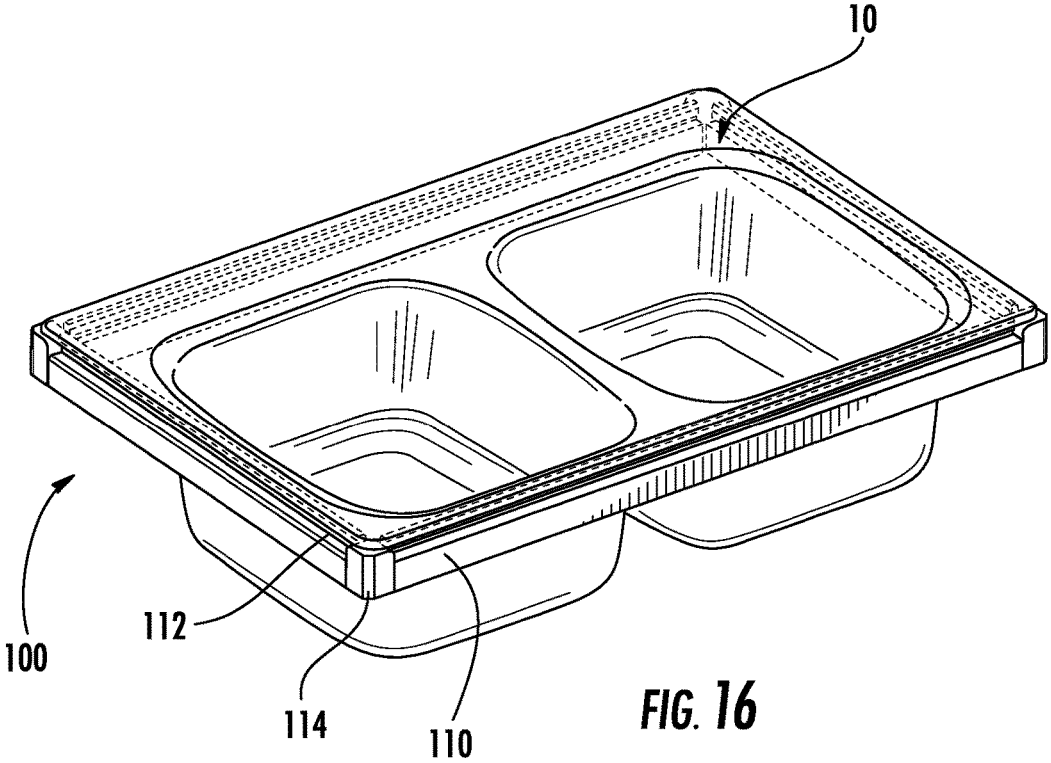
FIG. 16 is a perspective view of the manufacturing tool of FIG. 15 showing the placement of the sink over the channels according to an exemplary embodiment.

As shown in FIG. 16, a sink 10 is provided over the channels 40 within the manufacturing tool 100. As is readily evident to one having skill in the art, the manufacturing tool 100 is constructed to complement the particular sink assembly being made. In other words, the manufacturing tool 100 is constructed to have a corresponding shape and size to that of the particular sink being constructed.

Figure 17:
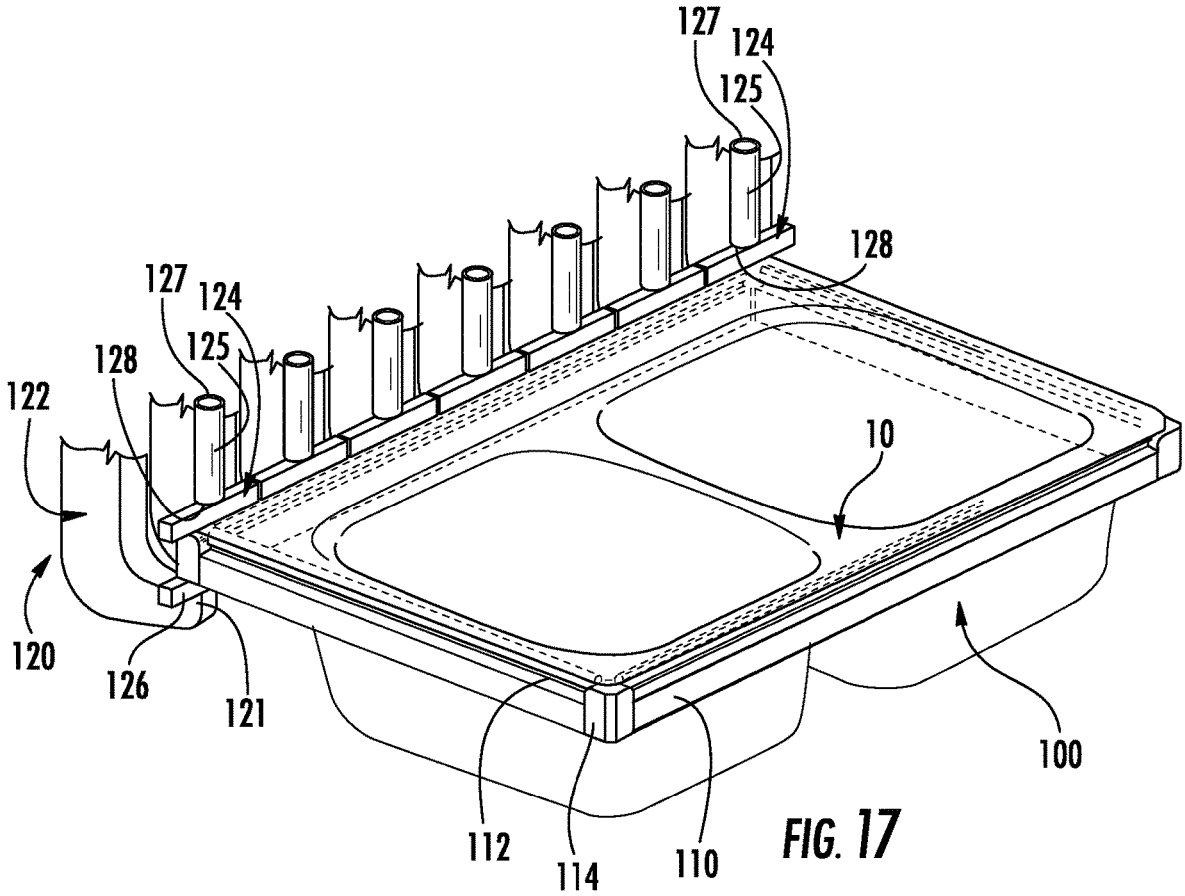
FIG. 17 is a perspective view of a clamping assembly for use with the manufacturing tool and sink of FIG. 16 according to an exemplary embodiment.
Figure 18:
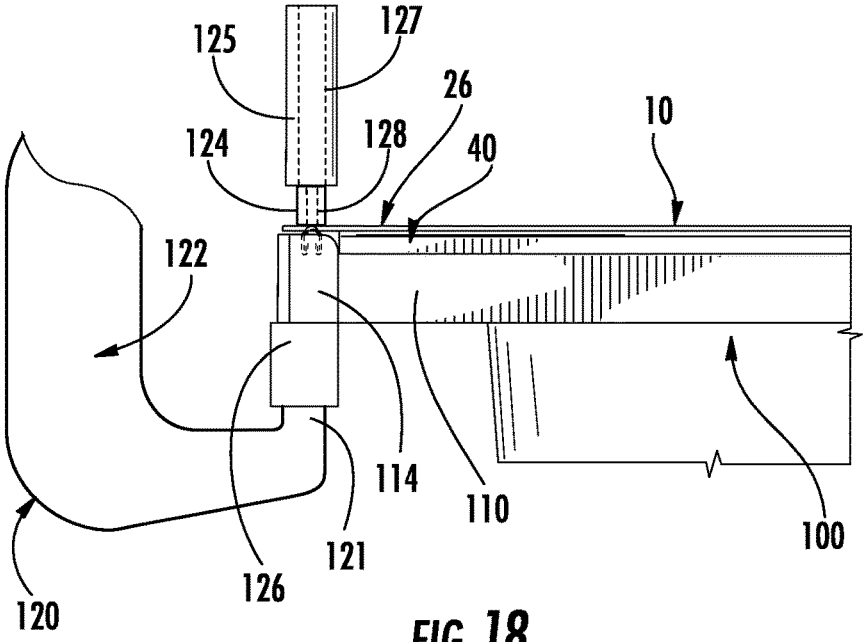
FIG. 18 is a side view of the clamping assembly, manufacturing tool, and sink of FIG. 17.

Referring now to FIGS. 17 and 18, a clamping system 120 is shown according to an exemplary embodiment. The clamping system 120 includes a series of clamping assemblies configured to simultaneously clamp one complete entire side of the sink 10 (e.g., one channel 40 to the underside 38 of the mounting rim 26). This ensures greater reduction in waviness of the mounting rim 26, as the entire side of the mounting rim is clamped at the same time. As shown in FIG. 17, this particular embodiment includes seven clamping assemblies. However, according to other exemplary embodiments, a greater or lesser number of clamping assemblies may be employed by the clamping system 120.

According to the exemplary embodiment shown in FIGS. 17 and 18, each clamping assembly includes a clamping member 122 having a bottom clamping bar 126 located on an end 121 of the clamping member 122. The bottom clamping bar 126 is configured to contact an underside of either the base member 110 and/or corner member 114. Each clamping assembly also includes a top clamping bar 124 coupled to a support tube 125. The top clamping bar 124 is configured to contact the topside 36 of the mounting rim 26, and, in combination with the bottom clamping bar 126, exert a clamping force on the channel 40 and the mounting rim 26. According to one exemplary embodiment, the clamping force may be mechanically generated. According to another exemplary embodiment, the clamping force may be pneumatically generated. According to other exemplary embodiments, the clamping force may be a combination of mechanical and pneumatic, or otherwise generated (e.g., fluid pressure, etc.).

As shown in FIG. 18, the top clamping bar 124 has a through hole 128 that is aligned with a through hole 127 of the support tube 125. As such, the aligned through holes 127 and 128 allow for welding of the channel 40 to the mounting rim 26 to occur. For example, the aligned through holes 127 and 128 may allow for laser welding, spot welding, and/or resistance welding. According to one exemplary embodiment, the welding through the aligned through holes 127 and 128 occurs simultaneously. According to other exemplary embodiments, the welding through the aligned through holes 127 and 128 occurs sequentially (e.g., left to right, right to left, center out, outside in, or any other suitable configuration).

Figure 19:
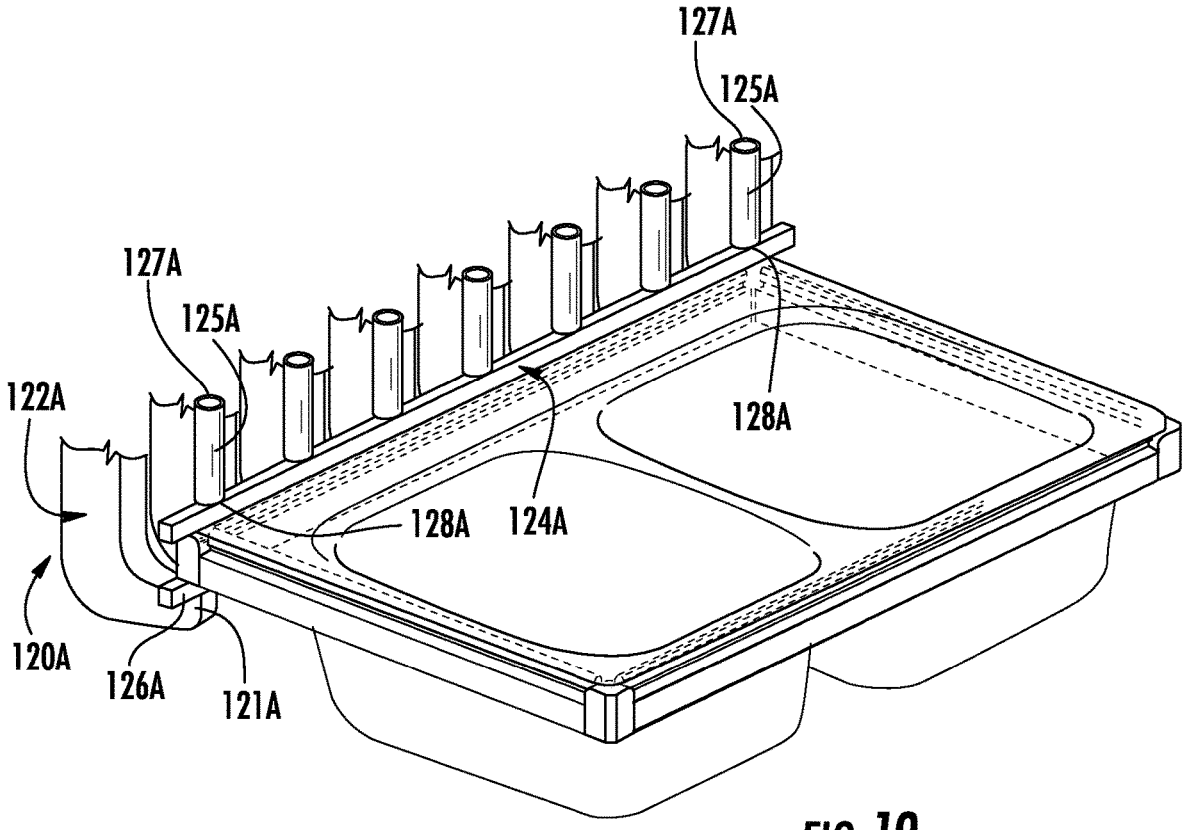
FIG. 19 is a perspective view of a clamping assembly for use with the manufacturing tool and sink of FIG. 16 according to another exemplary embodiment.

Referring now to FIG. 19, an alternative clamping system 120A is shown according to an exemplary embodiment. While the clamping system 120A includes many similar components to that shown in FIG. 17 (with similar components labeled with an "A" suffix), the clamping system 120A includes a single top clamping bar 124A that extends the entire length of the sink. As such, there are no intermediate gaps in between adjacent top clamping bars 124, as shown in FIG. 17. Likewise, a single bottom clamping bar 126A may also be used (e.g., that extends along the entire underside of the sink).

It should be noted that while the clamping systems 120, 120A are described above with respect to a welding process, the clamping systems may also be implemented using glue or adhesive. For example, glue or adhesive may be applied to the base portions 41 of the channels 40 after the channels 40 have been provided over the channel supports 112 as shown in FIG. 15. The glue or adhesive may be applied as a constant bead (e.g., as a continuous line), or intermittently (e.g., as a dashed line). After application of the glue or adhesive, the sink 10 is provided into the manufacturing tool 100, and the mounting rim 26 is clamped or held in place to the channels 40 via the clamping system 120 or 120A (or other appropriate clamping system) long enough to allow the glue or adhesive to bond the components together.

According to one exemplary embodiment, the corresponding surfaces of the channels 40 and the mounting rim 26 may be subjected to a surface preparation step prior to having the glue or adhesive applied. For example, the corresponding surfaces may be subjected to a decontamination step or process (e.g., to remove any surface debris and/or oils). According to various exemplary embodiments, examples of glue or adhesive may include Parson 7300 or 7420, Permabond TA4840, or Loctite 4710.

Accordingly, a sink assembly is provided with a number of benefits relating to its fabrication and installation. Among other things, coupling channels to the mounting rim of the sink reduces the waviness or warping of the mounting rim between the upper portion of the basin and the outer periphery of the mounting rim, resulting in increased flatness of the mounting rim. During installation, the mounting rim will contact the top of the countertop and so ensuring the planarity of the mounting rim helps to ensure robust installation of the sink.

As such, the mounting rim and any faucet deck of the sink will exhibit exceptional strength and planarity for a drawn sink. As warping is avoided, fewer mounting elements need to be used to ensure that the sink is flush with the top side of the countertop and that features along the mounting rim, such as the faucet deck, are also sufficiently planar to support water fixtures or the like. This means that the holes for the water fixtures can be pre-formed in the sink itself and do not need to be drilled in the countertop at the site of installation.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the sink and sink assembly as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A method for making a sink with a supporting structure, comprising:

drawing a sink including at least one basin and a rim extending outwardly from at least one side of the at least one basin; and coupling a support structure in the form of at least one channel to an underside of the rim using a tool;

wherein the tool includes a channel support having a surface configured to receive one channel of the at least one channel such that the channel is configured to at least partially surround the channel support.

2. The method of claim 1, wherein the channel support has an exterior profile to match an interior profile of the channel.

3. The method of claim 2, further comprising clamping together the at least one channel to the underside of the rim using a clamping system including a plurality of clamping assemblies.

4. The method of claim 3, wherein each clamping assembly includes a clamping member, a bottom clamping bar provided on an end of the clamping member, and a top clamping bar, wherein the bottom clamping bar is configured to contact the tool and the top clamping bar is configured to contact a top surface of the rim.

5. The method of claim 4, wherein the top clamping bar includes a through hole that is aligned with a through hole of a support tube, and wherein the support tube is coupled to the top clamping bar.

6. The method of claim 1, wherein the rim of the sink extends outwardly from a plurality of sides of the at least one basin, the support structure includes a channel coupled to the underside of each side of the plurality of sides, and the tool includes a plurality of channel supports that are each associated with one of the channels.

7. A method of making a sink, comprising:

drawing a sink including a basin and a rim extending outwardly from at least one side of the basin;

positioning a channel at an underside of the rim using a tool, the tool comprising:

a channel support having a surface configured to receive and support the channel such that the channel is configured to at least partially surround the channel support; and a clamping bar configured to support a topside of the rim; and coupling the channel to the rim by exerting a clamping force on the channel and the rim with the channel support and the clamping bar.

8. The method of claim 7, wherein coupling the channel to the rim further comprises welding the channel to the rim.

9. The method of claim 8, wherein the welding is performed using at least one of laser welding, resistance welding, spot welding, and ultrasonic welding.

10. The method of claim 8, wherein the tool includes a support tube coupled to a portion of the clamping bar, the clamping bar includes a through hole that is aligned with a through hole of the support tube, and the channel is welded to the rim through the through holes.

11. The method of claim 7, wherein coupling the channel to the rim further comprises gluing the channel and the rim together.

12. The method of claim 11, further comprising removing any surface debris associated with gluing the channel and the rim together.

13. A method of making a sink, comprising:

drawing a sink including a basin and a rim extending outwardly from a side of the basin; and coupling a channel to an underside of the rim using a tool;

wherein the tool includes a channel support having a surface configured to receive the channel such that the channel is configured to at least partially surround the channel support.

14. The method of claim 13, wherein the channel support has an exterior profile to match an interior profile of the channel.

15. The method of claim 14, further comprising clamping together the channel to the underside of the rim using a clamping system including a plurality of clamping assemblies.

16. The method of claim 15, wherein each clamping assembly of the plurality of clamping assemblies includes a clamping member, a bottom clamping bar provided on an end of the clamping member, and a top clamping bar, wherein the bottom clamping bar is configured to contact the tool and the top clamping bar is configured to contact a top surface of the rim.

17. The method of claim 16, wherein the top clamping bar includes a through hole that is aligned with a through hole of a support tube, and wherein the support tube is coupled to the top clamping bar.

18. The method of claim 13, wherein the rim extends outwardly from a plurality of sides of the basin, wherein the channel is one of a plurality of channels, wherein the plurality of channels are coupled to the underside of each respective side of the plurality of sides, and wherein the tool includes a plurality of channel supports that are each associated with one of the plurality of channels.

19. The method of claim 13, wherein coupling the channel to the rim further comprises welding the channel to the rim.

20. The method of claim 13, wherein coupling the channel to the rim further comprises gluing the channel and the rim together.

* * * * *